US005375396A

United States Patent [19]

Hüwelmann

[11] Patent Number: 5,375,396

[45] Date of Patent: Dec. 27, 1994

[54] APPARATUS FOR FILLING UNILATERALLY OPEN SACKS

[75] Inventor: Helmut Hüwelmann, Lengerich, Germany

[73] Assignee: Windmoeller & Hoelscher, Lengerich, Germany

[21] Appl. No.: 35,285

[22] Filed: Mar. 22, 1993

[30] Foreign Application Priority Data

Mar. 23, 1992 [DE] Germany ..... 9203879
Jun. 5, 1992 [DE] Germany ..... 9207679

[51] Int. Cl.[5] ..... B65B 1/32; B65B 3/28; B65B 43/16; B65B 43/18

[52] U.S. Cl. ..... 53/502; 53/570; 156/83; 156/114

[58] Field of Search ..... 53/502, 570, 384.1, 53/386.1; 156/10, 83, 114, 194

[56] References Cited

U.S. PATENT DOCUMENTS

| | | | |
|---|---|---|---|
| 2,546,193 | 3/1951 | Lindstaedt et al. | 226/61 |
| 4,137,689 | 2/1979 | McClusky et al. | 53/502 |
| 4,235,067 | 11/1980 | Parsons | 53/502 |
| 4,537,013 | 8/1985 | Tetenborg et al. | 53/570 |
| 4,873,815 | 10/1989 | Tetembprg et al. | 53/570 |
| 4,928,473 | 5/1990 | Nagao et al. | 53/502 X |

FOREIGN PATENT DOCUMENTS

| | | |
|---|---|---|
| 1000561 | 2/0789 | Belgium . |
| 0290879 | 11/1988 | European Pat. Off. . |
| 499716 | 6/1930 | Germany . |
| 3006505 | 9/1981 | Germany . |
| 3319901 | 12/1984 | Germany . |
| 3514575 | 6/1986 | Germany . |
| 9207679 | 8/1992 | Germany . |
| 736787 | 9/1955 | United Kingdom . |

*Primary Examiner*—Horace M. Culver
*Attorney, Agent, or Firm*—Jacobson, Price, Holman & Stern

[57] ABSTRACT

Sacks which are open on one side and which are preferably provided with side folds are gripped at their side sections in the area of their opening edges by pairs of grippers. The grippers can be displaced towards and away from each other. The lateral walls of the sacks are pulled apart in the area of the opening edges between the grippers by suction elements arranged on a rack. In the rack there are arranged filling necks which are lowerable into the open sacks. A sealing device closes the open edges of the sacks which are pulled taut by moving apart the grippers so that the open edges are laid on each other as a result thereof. In order to be able to detect the desired net weight of the filling quantity with high accuracy, the pairs of grippers and the drive for the opening and closing movements thereof and for the displacement of the grippers towards and away from each other are arranged on a frame which are connected with the rack by weighing devices.

4 Claims, 2 Drawing Sheets

APPARATUS FOR FILLING UNILATERALLY OPEN SACKS

FIELD OF THE INVENTION

The invention refers to an apparatus for filling sacks which are open on one side and which are preferably provided with side folds.

BACKGROUND OF THE INVENTION

During the filling of sacks it is necessary to fill them with a certain filling weight in order to obtain sacks with a uniform weight which can be sold by the piece.

In an apparatus of the kind described in EP-A-290 879, the sacks are filled via a filling neck with a predetermined quantity of filling material being previously weighed out, so that due to the filling of the sacks with a net filling amount, a weighing of the sacks suspended from a pair of grippers is not necessary during filling. This method of filling sacks with a weighed out net filling amount is, however, impossible when the sacks are filled with filling material of a poor flowing behavior, e.g. with liquid filling material of a high viscosity, since such filling materials tend to adhere to the filling neck or to the guide means used for the filling, so that when a net filling amount is fed via the filling neck it is not clear whether the complete quantity of filling material will be received entirely by the sack or bag to be filled.

If the filling of sacks or bags with a previously weighed net filling quantity is impossible, a so-called gross weighing must be carried out, which means that the sacks are weighed during their filling with the filling material and the sacks are filled until the weighing indicates the desired amount of filling. This kind of gross weighing includes the problem that not just the sack along, together with the filling amount received by the sack is weighed, but that also the means holding the sack during filling must be weighed together with the sack and the filling quantity. The weight of the means holding the sack enters into the gross weighing as dead weight so that, when taking into account this dead weight, even for small relative errors (inaccuracies) in the measuring result of the gross weighing, relatively large deviations from the desired net weight to be filled into the sacks may be obtained.

From DE-PS 499 716 as well as from U.S. Pat. No. 2,546,193, filling apparatus for sacks with a gross weighing of the filling quantity are known, in which, however, in addition to the holding means for the sacks to be filled, the entire filling hopper arrangement is included in the dead weight weighed therewith. For that reason it is impossible in these known apparatus to keep the inevitable relative measuring error so small during weighing that the absolute errors of the desired filling amount can be kept in the desired small and, therefore, negligible range.

SUMMARY OF THE INVENTION

Therefore, it is an object of the present invention to provide an apparatus by which, also in case of a gross weighing of the sacks during their filling, the desired net weights of the filling quantities can be obtained with high accuracy.

This problem is solved according to the invention for an apparatus of the kind mentioned hereinbefore by a pair of grippers and a drive means for the opening and closing movements of the pair of grippers and for displacing the grippers towards and away from each other. The pair of grippers is arranged on a carrying means which is connected to a rack via weighing devices. Hence, in the aparatus according to the invention, only the means for holding the sack is suspended from a weighing device or supported thereon so that the dead weight also weighed during the gross weighing can be kept as small as possible.

Consequently, in the apparatus according to the invention even with respect to the net filling amount, the relative weighing error resulting from the entire weighed out weight can be kept small so that the sacks or bags can be filled with the desired filling quantity, even if filling materials with a poor flowing behavior or with a high viscosity are filled therein. In the apparatus according to the invention the filling neck advantageously is provided with a closing means at its lower section so that the filling process can be interrupted when the weighing performed during the filling indicates the desired weight of the filling or when, taking into account the last running of the filling quantity, the desired nominal weight has just been reached.

After filling, sacks filled by the apparatus according to the invention can be sealed in a usual manner. When the filled sacks or bags are made of a plastic film of thermoplastic material, the opening edges laid next to each other by being pulled taut, can be joined by a transverse weld. A sealing can also be carried out by folding over the edges of the opening and sealing thereof with transverse sewing seams, e.g. by application of a rider strip.

Advantageously, the weighing device includes a pressure measuring means by which the carrying device is supported in the rack. There can be provided, e.g. two or three pressure pickups, by which the carrying device including a crossbeam or the like is supported on the rack.

The drive means moving the grippers of the pair of grippers towards and away from each other may include two parallel guide rods, respectively, hinged to the carrying device, which form a four-bar system together with the grippers, the four-bar system being pivotable by pressure-means such as piston cylinder units, e.g. pneumatic cylinders.

For some filling material it may be necessary to provide hopper outlet doors or stretcher plates in addition to the filling neck. According to a further embodiment of the invention, the carrying means hopper outlet doors or stretcher plates, which can be pivoted about parallel axes, are mounted so that they can be spread apart or moved into a V-shaped closing position by drive means. In their closed V-shaped location, the hopper outlet doors lie above the opening edge, opened by suction elements. By pivoting the two hopper outlet doors into the open position, they move into the sack and thereby force the opening edges of the sack apart so that the filling neck may be moved into the sack without coming into contact with the sack, after the suction elements which have pre-opened the sack, have been removed from the sack walls.

Instead of special hopper outlet doors, also stretcher plates can be provided.

The apparatus of the invention therefore includes a pair of grippers gripping sacks in an area of edges of the openings of the sacks at their side sections and the grippers being displaceable towards and away from each other, a device keeping apart the lateral walls of the sacks in the area of the edges of the opening between the grippers, the device preferably being a pair of suction elements which spread the edges apart, a filling neck arranged in a rack, which can be lowered into and lifted from the opened sacks, and a sealing unit for sealing the edges of the opening of the sacks with transverse seams, wherein the edges of the opening have been pulled taut by moving the grippers apart and therefore the edges of the opening are resting on each other.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
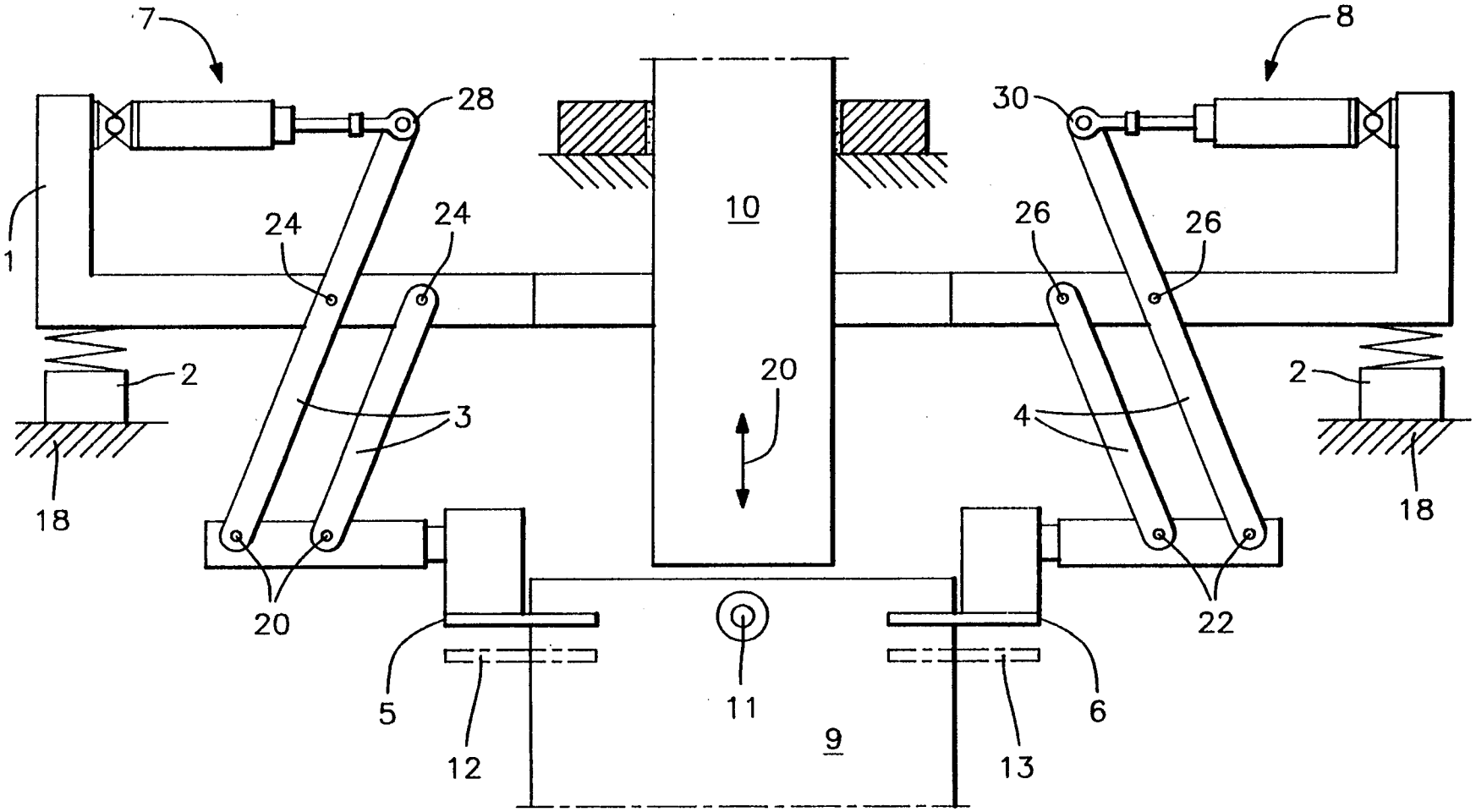
FIG. 1 shows a lateral view of a schematic representation of a gross weighing device of a sack or bag filling apparatus with a feed pipe.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

In the apparatus according to FIG. 1, the pair of grippers 5 holding the sack 9 during filling are mounted on a carrying element or frame 1 which is supported on the rack 18 of the filling apparatus by means of pressure pickups or force pickups 2.

Parallelogram linkages 3 and 4, which at their lower ends 20, 22 respectively, each have a pair of grippers or holding and spreader tongs 5 and 6, respectively, which are pivotally connected to the frame 1 at pivot points 24, 26 respectively. By means of piston cylinder units 7 and 8 connected to the parallelogram linkages 3 and 4 at their upper ends 28, 30 respectively, and being mounted on the frame 1, the pair of holding and spreader tongs 5, 6 may be moved towards and away from each other.

A sack 9 gripped by the pair of holding and spreader tongs 5 and 6 is drawn open laterally in the area of a filling hopper 10 by suction elements 11 located on both sides of the sack 9. The pair of holding and spreader tongs 5 and 6 are simultaneously moved towards each other during the drawing open of the sack 9 by suction elements 11.

After the opening of sack 9 at the upper filling edge 32 the filling pipe 10 is lowered into the sack in the downward direction of line 20, whereupon the suction elements 11 can be removed from the sack. A valve (not shown) is associated with the filling pipe 10, advantageously in a lower section thereof. The valve closes the filling pipe 10 at the moment when the pressure pickup 2 indicates a predetermined weight for sack 9 along with its contents. The filling pipe 10 is then lifted in the upward direction of line 20, whereupon the pair of holding and spreader tongs 5 and 6 are moved away from each other in order to close the opening edge 32.

At this point in time, also the pairs of transport tongs 12 and 13 are advanced toward the sack 9 so as to grip sack 9 and transport sack 9 away after the sealing of the opening of the sack as held by the pair of holding and spreader tongs 5 and 6. When it is explained in this embodiment that the pairs of tongs 12 and 13 are used for removing a filled sack 9, an empty sack is transported into the space between the pair of holding and spreader tongs 5 and 6 by a pair of transport tongs (not shown).

The pair of holding and spreader tongs 5, 6 consist of two tong-like opening and closing clamping bars which can be pivoted at one end about an axis lying approximately in the pivoting plane of the parallelogram linkages 3, 4. The holding and spreader tongs 5, 6 and their drive means are of known structure and are therefore not described in detail.

Figure 2:
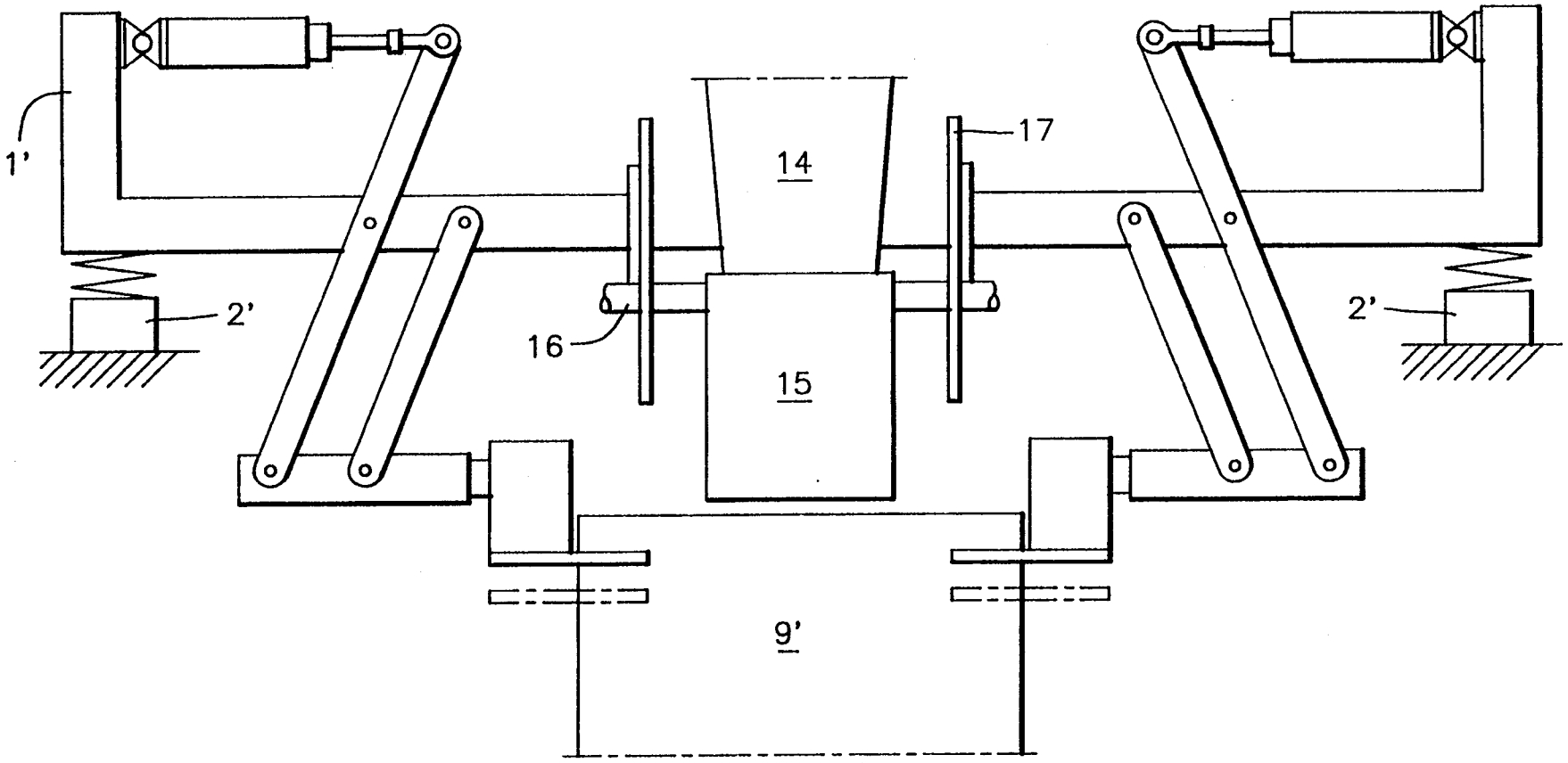
FIG. 2 shows a view of a gross weighing device in accordance with FIG. 1, in which in addition, hopper outlet doors are provided which open the sack and move into the sack.

The embodiment represented in FIG. 2 differs from that of FIG. 1 in that for filling sacks 9', filling hopper 14 is used to which are associated pivotal hopper outlet doors. During opening, the hopper outlet doors 15 are moved into the sack and due to their pivotal movement, come to lie against the sack walls. The two swivel shafts 16 of the hopper outlet doors 15 are connected with the frame 1' by means of sheet metal holders or holding lugs 17. The manner of the bearing of the two hopper outlet doors 15 on a carrying rack and the drive means for opening and closing the two hopper outlet doors 15 are of a known kind and are therefore not explained in detail here.

Since the hopper outlet doors 15 are mounted to the frame 1' by means of holding lugs 17, also their weight is additionally entered into the total weight when a gross weighing is carried out. But since this weight is not very large, it is only entered with a small relative absolute error into the relative measuring error during the gross weighing. The arrangement of the hopper outlet doors 15, however, prevents the filling hopper 14 from coming into contact with the lateral walls of the sack 9' to be filled, so that during weighing, indefinable inaccuracies are prevented from being obtained.

Having described the invention, many modifications thereto will become apparent to those skilled in the art to which it pertains without deviation from the spirit of the invention as defined by the scope of the appended claims.

I claim:

1. Apparatus for filling unilaterally open sacks provided with side folds, said apparatus comprising:
   - a pair of grippers for gripping sacks at open edges at their side sections,
   - drive means for displacing said pair of grippers towards and away from each other,
   - means for keeping apart lateral walls of the sacks at their open edges between said pair of grippers, said means including a pair of suction elements for spreading apart the lateral walls,
   - a filling neck for lowering into and lifting from the opened sacks,
   - carrying means for supporting said pair of grippers and said drive means,
   - a rack, and
   - weighing means for supporting said carrying means on said rack.

2. Apparatus according to claim 1, wherein said weighing means include pressure measuring means.

3. Apparatus according to claim 1, wherein said drive means moves grippers of said pair of grippers towards and away from each other by two parallel guide rods, respectively, hinged to said carrying means and forming a four-bar system together with said grippers, and said four-bar system being pivoted by piston cylinder units.

4. Apparatus according to claim 1, wherein hopper outlet doors mounted on said carrying means are pivotal about parallel shafts spread apart and moved into a V-shaped closing position.

* * * * *